US010537174B2

(12) United States Patent
Quintong

(10) Patent No.: US 10,537,174 B2
(45) Date of Patent: Jan. 21, 2020

(54) MAGNETIC FURNITURE LEG GLIDE

(71) Applicant: Theresa Quintong, New York, NY (US)

(72) Inventor: Theresa Quintong, New York, NY (US)

( * ) Notice: Subject to any disclaimer, the term of this patent is extended or adjusted under 35 U.S.C. 154(b) by 0 days.

(21) Appl. No.: 16/021,196

(22) Filed: Jun. 28, 2018

(65) Prior Publication Data

US 2019/0000231 A1 Jan. 3, 2019

Related U.S. Application Data

(60) Provisional application No. 62/525,790, filed on Jun. 28, 2017.

(51) Int. Cl.

| | |
|---|---|
| ***A47C 31/00*** | (2006.01) |
| ***A47B 91/08*** | (2006.01) |
| ***A47B 91/06*** | (2006.01) |

(52) U.S. Cl.

CPC ..... *A47B 91/08* (2013.01); *A47B 91/06* (2013.01); *A47C 31/003* (2013.01)

(58) Field of Classification Search

USPC .... 248/188.9, 188.8, 206.5, 309.4, 501, 502

See application file for complete search history.

(56) References Cited

U.S. PATENT DOCUMENTS

| | | | | |
|---|---|---|---|---|
| 6,042,080 | A * | 3/2000 | Shepherd | B60R 11/00 248/163.1 |
| 6,042,183 | A * | 3/2000 | Carnahan | A47C 7/004 297/310 |
| 6,840,488 | B2 * | 1/2005 | Ngo | A47B 91/12 248/188.2 |
| 8,230,552 | B2 * | 7/2012 | Klugh | A61H 3/0288 16/21 |
| 2014/0197296 | A1 * | 7/2014 | Jones | A47B 91/12 248/346.11 |

* cited by examiner

*Primary Examiner* — Alfred J Wujciak

(74) *Attorney, Agent, or Firm* — Dale J. Ream

(57) ABSTRACT

A magnetic leg glide apparatus for holding an outdoor furniture article against a ground surface in windy weather conditions includes a base member that includes a mounting plate constructed of a magnetic material and having a circular and planar configuration and that includes a fastener having a linear configuration extending away from a bottom side of the base member. The magnetic leg glide apparatus includes a glide member having a bottom wall constructed of a magnetic material of an opposite polarity to the magnetic material of the base member, the glide member having a side wall extending upwardly from a peripheral edge of the bottom wall, the side wall defining an open top and an interior area accessible via the open top for operably receiving a leg of the outdoor furniture article. The base member and the glide member are magnetically attracted to one another.

8 Claims, 6 Drawing Sheets

MAGNETIC FURNITURE LEG GLIDE

REFERENCE TO RELATED APPLICATIONS

This application claims the benefit of provisional patent application U.S. Ser. No. 62/525,790 filed Jun. 28, 2017 titled "Magnetic Furniture Leg Glide" and which is incorporated herein by reference.

BACKGROUND OF THE INVENTION

This invention relates generally to furniture leg gliders and, more particularly, to a magnetic leg glide apparatus for holding an outdoor furniture article against a ground surface in windy weather conditions.

There was a time when outdoor furniture was routinely constructed of thick metal arrangements that were immovable in windy conditions. Unfortunately, metal outdoor furniture was, therefore, heavy and difficult for a user to move without assistance or, at least, great effort. More recently, outdoor furniture, such as chairs and tables, are constructed of lightweight plastic materials. Although easier to move around during use or even in transport, the lightweight furniture is often overturned or completely blown away by high wind conditions.

Therefore, it would be desirable to have a magnetic leg glide apparatus that not only protects against furniture legs scratching a floor surface when the furniture is moved, but that inhibits or prohibits the furniture from movement during high winds. Further, it would be desirable to have a magnetic leg glide apparatus having one or a plurality of magnetic base members that may be inserted into a ground, deck, patio, or floor surface and a plurality of glide members for receiving the legs of outdoor furniture, respectively, that are also magnetic.

SUMMARY OF THE INVENTION

A magnetic leg glide apparatus according to the present invention for holding an outdoor furniture article against a ground surface in windy weather conditions includes a base member that includes a mounting plate constructed of a magnetic material and having a circular and planar configuration and that includes a fastener having a linear configuration extending away from a bottom side of the base member. The magnetic leg glide apparatus includes a glide member having a bottom wall constructed of a magnetic material of an opposite polarity to the magnetic material of the base member, the glide member having a side wall extending upwardly from a peripheral edge of the bottom wall, the side wall defining an open top and an interior area accessible via the open top for operably receiving a leg of the outdoor furniture article. The base member and the glide member are magnetically attracted to one another.

Therefore, a general object of this invention is to provide a magnetic leg glide apparatus for holding an outdoor furniture article against a ground surface in windy weather conditions.

Another object of this invention is to provide a magnetic leg glide apparatus, as aforesaid, that includes a base member configured to pierce and penetrate a ground or flooring material and be anchored therein.

Still another object of this invention is to provide a magnetic leg glide apparatus, as aforesaid, that includes a glide member configured to receive a leg of an outdoor furniture article and to be coupled to the base member.

Yet another object of this invention is to provide a magnetic leg glide apparatus, as aforesaid, in which the base member and glide member are constructed of magnetically attractive materials.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
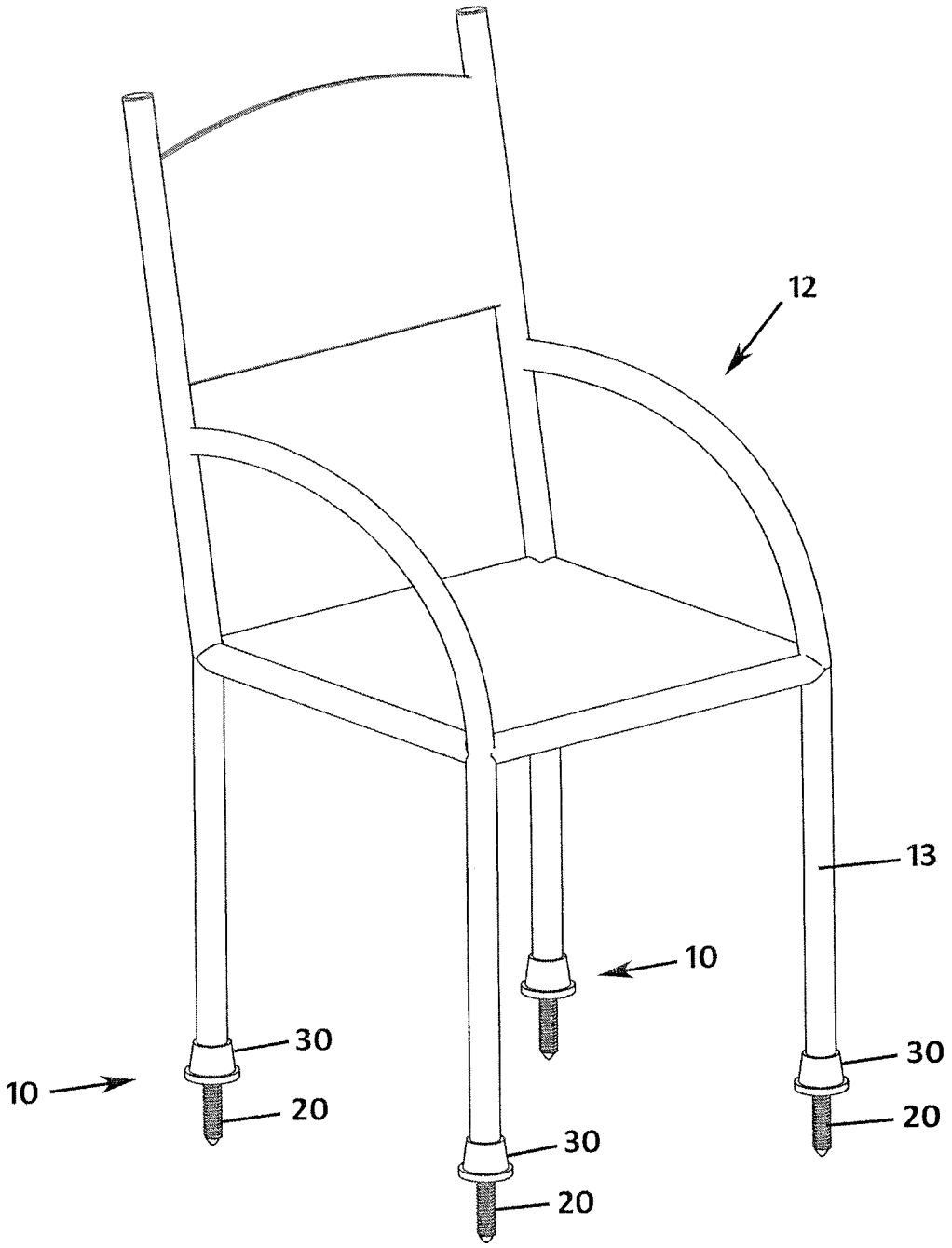
FIG. 1 is a perspective view of magnetic leg glide apparatus according to the present invention.
Figure 2:
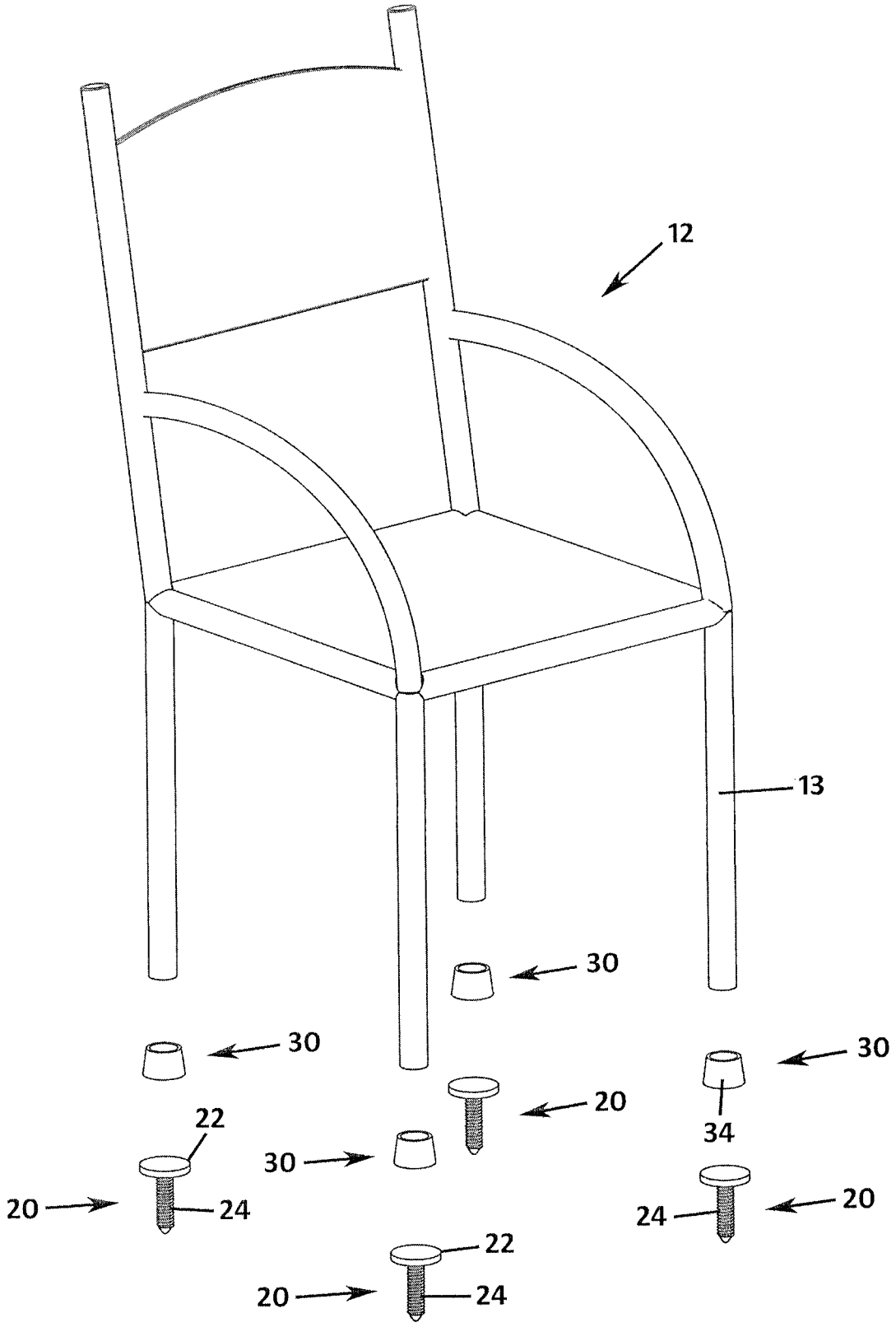
FIG. 2 is an exploded view of the magnetic leg glide apparatus as in FIG. 1.

A magnetic leg glide apparatus according to a preferred embodiment of the present invention will be described with reference to FIGS. 1 to 7 of the accompanying drawings. The magnetic leg glide apparatus 10 includes a base member 20 and a glide member 30, each member being magnetically attracted to the other and configured to secure the legs 13 of patio furniture, such as a plastic chair 12, against movement even in high wind conditions.

Figure 4:
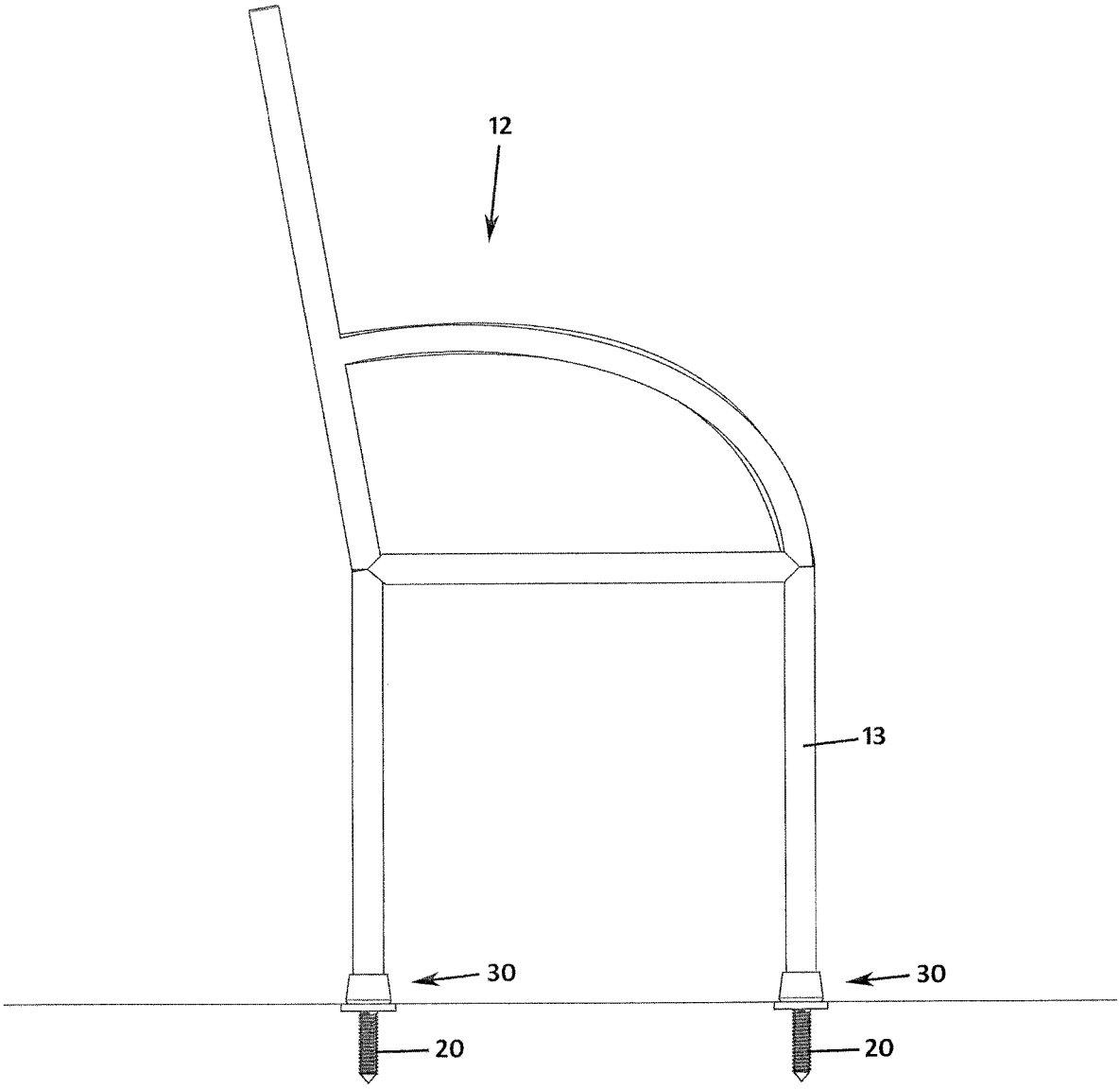
FIG. 4 is a side view of the magnetic leg glide apparatus as in FIG. 1, illustrated installed in a ground, patio, or floor surface.
Figure 5:
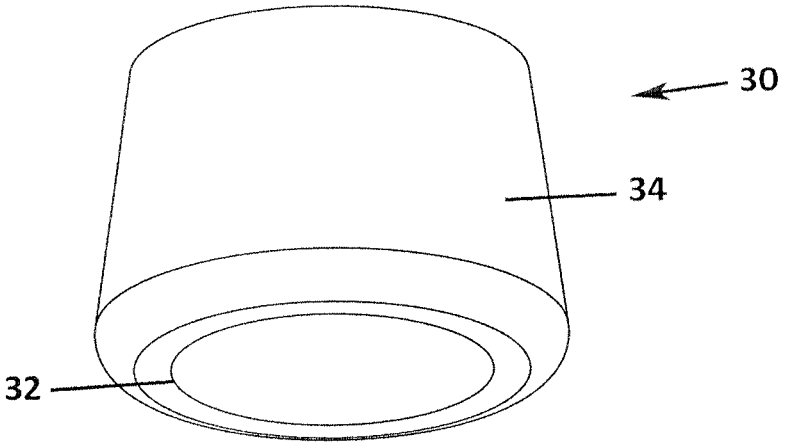
FIG. 5 is an isolated perspective view of a leg glide member according to the magnetic leg glide apparatus as in FIG. 1.

The base member 20 is, in its simplest form, a circular top plate with a downwardly extending anchor that may be anchored into a patio, deck, or floor surface, the top plate being magnetic. More particularly, the base member 20 includes a mounting plate 22 having a planar or flat configuration that will lay flat against a floor, patio, deck, or other flat surface. In fact, it is preferred that the base member 20 be installed at a slightly recessed configuration so as not to create a trip hazard when no glide member 30 is coupled thereto and also to enable a glide member 30 to move slidably onto a base member 20 without having to lift up the furniture and glide member 30 itself (FIG. 4). Preferably, the mounting plate 22 has a circular configuration that is very thin although other configurations may also be suitable. In an embodiment, the mounting plate 22 may have a circular configuration with a diameter between about 2.0 centimeters (cm) and 2.4 centimeters (cm) and, preferably, 2.2 cm. Also in an exemplary embodiment, the mounting plate 22 has a height or thickness of about 0.5 cm.

The mounting plate 22, or at least an top surface of the mounting plate 22, is constructed of a magnetic material. For instance, the top surface of the mounting plate may itself be a magnet such that another magnet having an opposite polarity or a conductor such as metal will be magnetically attracted to the mounting plate 22 as will be described later.

The downwardly extending anchor is a fastener 24 having a generally linear configuration. Preferably, the fastener 24 is taken from a group of fasteners that are capable of burrowing or piercing into a substrate, such as a group including a nail, screw, bolt, and other threaded fasteners. The fastener 24 may have a threaded surface to enhance its ability to burrow or drill into a surface and also to make it more difficult to be inadvertently pulled and removed. Preferably, the fastener 24 has a pointed tip 26. The fastener 24 is perpendicular to the mounting plate 22 and coupled to the bottom surface or underside of the mounting plate 22.

Now with reference to the glide member 30, the glide member 30 has a bottom wall 32 and a side wall 34 extending upwardly from a peripheral edge of the bottom wall 32. In an exemplary embodiment, the side wall 34 is a continuous side wall having a generally cylindrical configuration. While the bottom wall 32 is closed, the side wall 34 includes an upper peripheral edge 36 defining an open top and defining an interior area. The interior area has a size and configuration for selectively receiving a free end of a leg 13 of a piece of furniture 12, such as an outdoor patio chair. The side wall 34 may define a diameter adjacent the bottom wall 32 that is greater than a diameter adjacent the upper peripheral edge 36 such that the side wall 34 has an inwardly sloping configuration, causing the interior area to better grip and secure a leg 13 of a furniture article inserted therein. It is understood that the side wall 34 may include a plurality of side wall portions arranged in a square or rectangular configuration that is suited to receive similar configurations of legs of a chair.

The bottom wall 32 of the glide member 30 is constructed of a magnetic material so that it is magnetically attracted to the mounting plate 22 of the base member 20. For instance, the bottom wall 32 of the glide member 30 may simply have a metal construction that is attracted to the mounting plate 22 constructed of a magnetic material. Alternatively, the bottom wall 32 of the glide member 30 may itself be a magnet having a polarity opposite that of the polarity of the mounting plate 22. It is understood that the metal or metallic construction of the mounting plate 22 and bottom wall 32 of the glide member 30 may have different combinations of construction so long as these members are magnetically attracted to one another.

Figure 3:
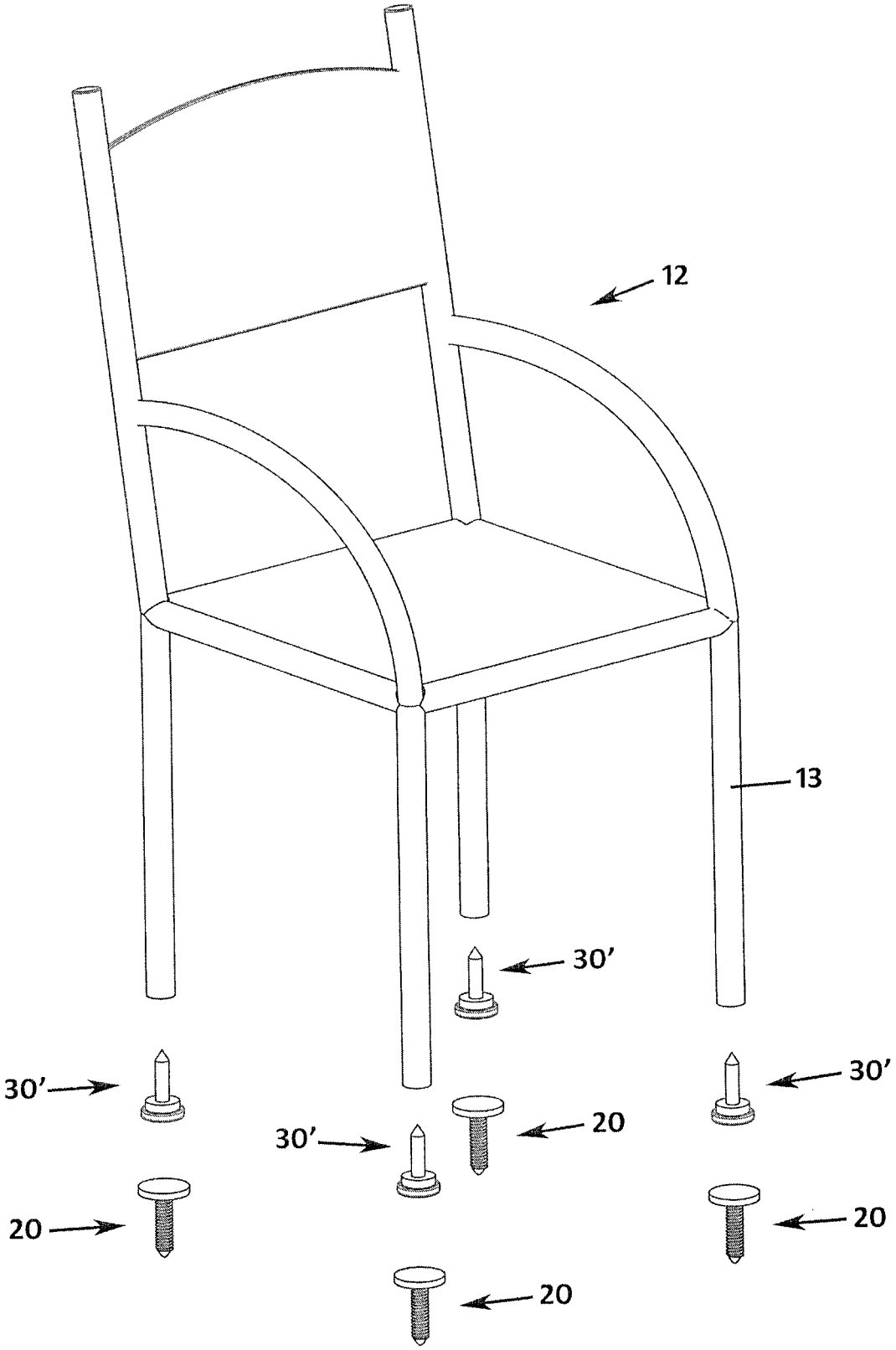
FIG. 3 is an exploded view of a related embodiment of the magnetic leg glide apparatus of FIG. 2.
Figure 6:
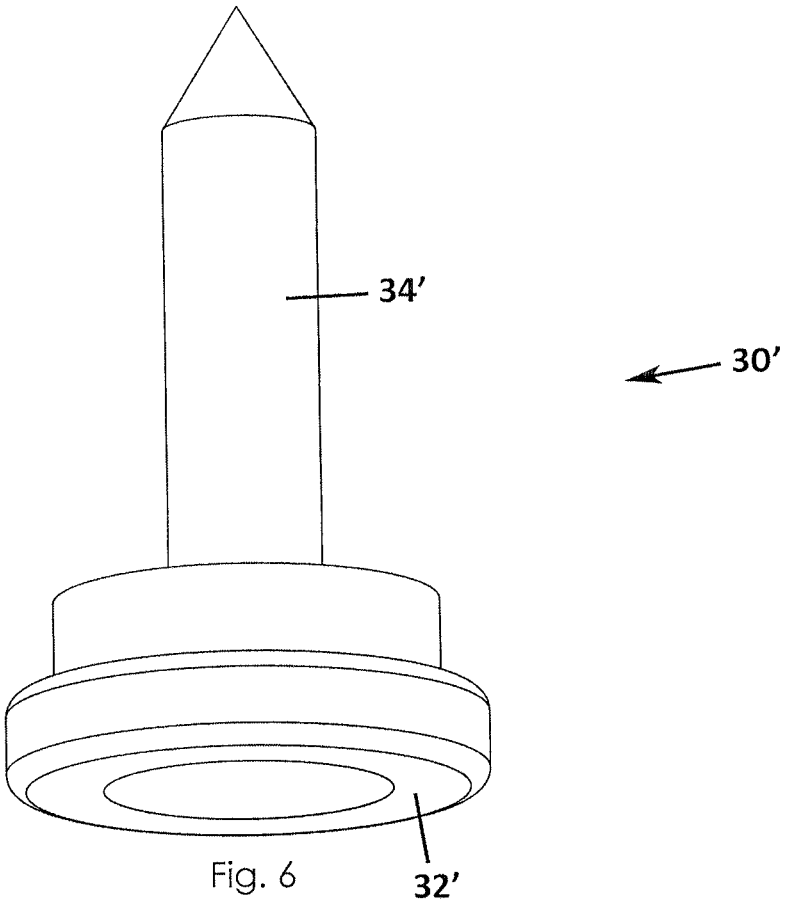
FIG. 6 is an isolated perspective view of a leg glide member according to the magnetic leg glide apparatus as in FIG. 3.
Figure 7:
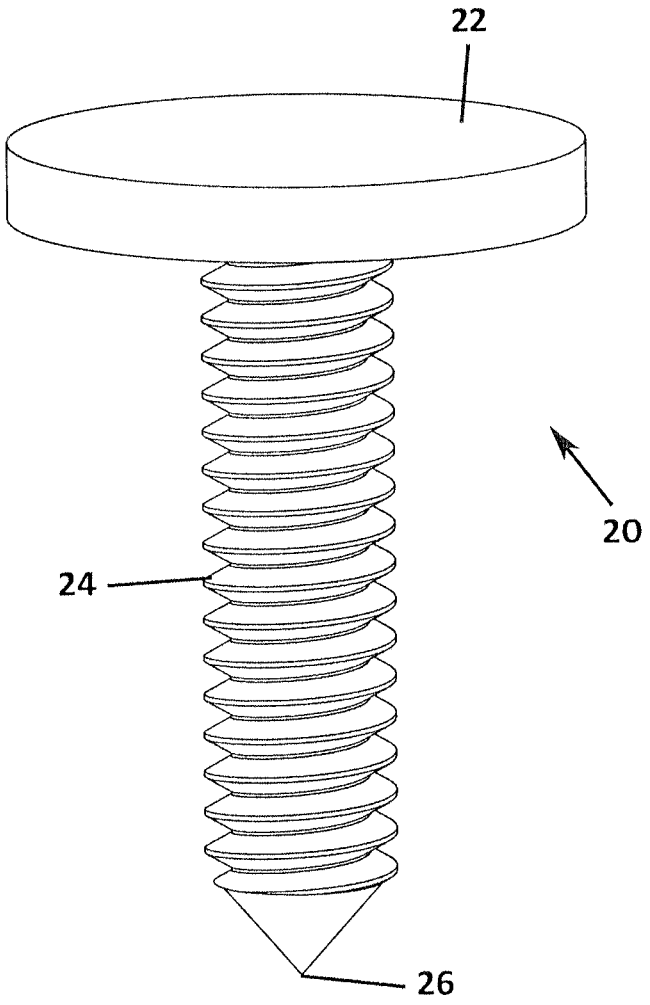
FIG. 7 is an isolated perspective view of a base member according to the magnetic leg glide apparatus as in FIG. 1.

In a related embodiment, a glide member 30' includes a bottom wall 32' that includes a magnet or otherwise constructed of a material that is attracted to a magnet of a mounting plate 22 of a base member 20 according to the construction described above. But, then in lieu of the side wall 34 for receiving a furniture leg 13, the glide member 30' includes a leg shaft 34' having a linear configuration extending upwardly away from the bottom wall 32' and that is configured either to impale a solid or closed leg end or simply to be frictionally inserted into an open leg end of a furniture article 12. (FIG. 3 and FIG. 6). The leg shaft 34' may or may not be threaded and may include a pointed tip. In the manner described above, the bottom wall 32' and the mounting plate 22 of a base member 20 are magnetically attracted toward one another.

In another aspect, it is important that a diameter of the bottom wall 32 is greater than a diameter of the mounting plate 22 as such a geometric relationship yields greater stability when coupled together.

In use, one or more base members 20 may be inserted and installed into a ground, deck, patio, or floor surface and, as such, will provide distinct positions for the legs of associated outdoor furniture to be positioned thereon. It is understood that each base member 20 should be inserted in a pattern that matches the leg pattern of a specific chair, couch, table, or the like. Then, each free end of a respective leg is inserted into an interior area of respective glide members in the manner of traditional furniture gliders. But, then, each glide member 30 may be placed atop respective base members 20 and corresponding magnetic surfaces will hold the furniture piece in place even when strong winds are experienced.

It is understood that while certain forms of this invention have been illustrated and described, it is not limited thereto except insofar as such limitations are included in the following claims and allowable functional equivalents thereof.

The invention claimed is:

1. A magnetic leg glide apparatus for holding an outdoor furniture article against a ground surface in windy weather conditions, said magnetic leg glide apparatus comprising:

a base member that includes a mounting plate having a planar and circular configuration and a fastener having a linear configuration for anchoring on the ground surface, having a unitary construction with said mounting plate and extending away from a bottom side of and perpendicular to said base member;

wherein said mounting plate is constructed of a magnetic;

a glide member having a bottom wall and a side wall extending upwardly from a peripheral edge of said bottom wall, said side wall defining an open top and an interior area accessible via said open top, said interior area operably receiving a leg of the outdoor furniture article;

wherein said side wall is a continuous side wall having an inwardly angled configuration for operably gripping the leg of the outdoor furniture article received in said interior area;

wherein said bottom wall is constructed of metal material so that said base member and said glide member are selectively movable between a first position displaced from one another and a second position magnetically coupled to one another for changing position of the furniture article.

2. The magnetic leg glide apparatus as in claim 1, wherein:

said mounting plate of said base member has a diameter of about 2.0 to 2.4 cm.

said mounting plate of said base member has a height of about 0.5 cm.

3. The magnetic leg glide apparatus as in claim 2, wherein said fastener is a screw having a linear configuration and a plurality of threads and a pointed tip operable to pierce a ground or solid surface.

4. The magnetic leg glide apparatus as in claim 1, wherein said fastener is one of a group consisting of a nail and a screw.

5. A magnetic leg glide apparatus for holding an outdoor furniture article against a ground surface in windy weather conditions, said magnetic leg glide apparatus comprising:

a base member that includes a mounting plate constructed of a magnetic material and having a circular and planar configuration and that includes a fastener fixedly coupled to one another for changing position of the furniture article having a linear configuration extending away from a bottom side of said base member; and a glide member having a bottom wall constructed of a magnetic material of an opposite polarity to the magnetic material of said base member, said glide member having a side wall extending upwardly from a peripheral edge of said bottom wall, said side wall defining an open top and an interior area accessible via said open top for operably receiving a leg of the outdoor furniture article;

wherein said side wall is a continuous side wall having an inwardly angled configuration for operably gripping the leg of the outdoor furniture article received in said interior area;

wherein said base member and said glide member are movable between a first position displaced from one another and a second position magnetically coupled to one another for changing position of the furniture article.

6. The magnetic leg glide apparatus as in claim 5, wherein:

said mounting plate of said base member has a diameter of about 2.2 cm and said mounting plate of said base member has a height of about 0.5 cm.

7. The magnetic leg glide apparatus as in claim 6, wherein said fastener is one of a group consisting of a nail and a screw.

8. The magnetic leg glide apparatus as in claim 5, wherein said fastener is a screw having a linear configuration and a plurality of threads and a pointed tip operable to pierce a ground or floor surface.

* * * * *